United States Patent [19]

Williams et al.

[11] Patent Number: 5,030,935

[45] Date of Patent: Jul. 9, 1991

[54] METHOD AND APPARATUS FOR DAMPENING RESONANT MODES IN PACKAGED MICROWAVE CIRCUITS

[75] Inventors: Dylan F. Williams, Boulder; Larry G. Hayden, Louisville, both of Colo.

[73] Assignee: Ball Corporation, Muncie, Ind.

[21] Appl. No.: 350,341

[22] Filed: May 11, 1989

[51] Int. Cl.[5] ..... H01P 1/16

[52] U.S. Cl. ..... 333/246; 361/399

[58] Field of Search ..... 333/246, 247, 238, 251, 333/22 R; 361/399

[56] References Cited

U.S. PATENT DOCUMENTS

| | | | |
|---|---|---|---|
| 3,863,181 | 1/1975 | Glance et al. | 333/246 X |
| 4,276,655 | 6/1981 | Kraemer et al. | 333/246 X |
| 4,344,053 | 8/1982 | Anderson | 333/251 |
| 4,480,240 | 10/1984 | Gould | 333/246 |
| 4,631,494 | 12/1986 | Gould | 333/246 X |

FOREIGN PATENT DOCUMENTS

| | | | |
|---|---|---|---|
| 147601 | 7/1986 | Japan | 333/22 R |

*Primary Examiner*—Benny Lee
*Attorney, Agent, or Firm*—Gilbert E. Alberding

[57] ABSTRACT

Dampening of unwanted resonant modes in a conductive enclosure for microwave circuitry carried on a conductive ground plane is provided by interrupting the ground plane at one or more locations about the microwave circuitry and providing electical resistance by either a resistive film or resistor spanning the one or more interruptions in the ground plane to thereby dampen one or more dominant resonant moded in the enclosure. One or more interruptions or openings for electrical resistance may be preferably located at locations of maximum current flow of the one or more dominant resonant modes excited by the operation of the microwave circuit, or may comprise a single space or gap provided in the ground plane surrounding the microwave circuitry with a plurality of resistors located about the circuitry to dampen the dominant resonant modes. The electrical resistance for dampening can be calculated with the computer program of Appendix 1.

24 Claims, 5 Drawing Sheets

METHOD AND APPARATUS FOR DAMPENING RESONANT MODES IN PACKAGED MICROWAVE CIRCUITS

This application includes, as Appendix 1, an eleven-page computer program entitled "Cavity" written in FORTRAN. Appendix 1 is currently the copyrighted, unpublished work of Ball Corporation, the assignee of this patent application, but the United States is hereby granted a license to publish Appendix 1 with the issuance of this application; and Ball Corporation hereby dedicates Appendix 1 to the public upon expiration of such a patent, but otherwise, reserves all copyrights in Appendix 1.

TECHNICAL FIELD

This invention relates to a method and apparatus for damping resonant modes in microwave assemblies and, more particularly, relates to large microwave packages including ground planes interrupted by portions with electrical resistance located to prevent unwanted, high-Q, resonant modes within the assembly.

BACKGROUND ART

Electrical and electronic circuitry is packaged for many reasons. Such packaging is important and essential to protect fragile circuit components from damage and to isolate the circuitry from its surrounding environments. The considerations to be resolved in packaging electrical and electronic circuitry include the protection of fragile circuit elements and connectors from breakage and other physical damage in handling and use, the prevention of unwanted transmission of electromagnetic radiation to the circuitry from the surrounding environment, and the containment of electromagnetic radiation generated in operation of the circuit. The latter two considerations generally require that the circuitry be surrounded by an enclosure of electrically conductive and magnetic material to isolate the circuitry electromagnetically from its environment.

These considerations have lead to over 60 years of inventive and developmental activity directed to circuitry shielding and packaging. A number of examples of such activity follow.

U.S. Pat. No. 1,641,395, for example, is directed to a composite shield for such radiation comprised of layers of a dielectric substrate, a thin metallic sheet, preferably half tin and half lead and a composite layer comprising preferably powdered borax and aluminum in an effort to provide rectification of radio energy and conduction to ground.

U.S. Pat. No. 2,321,587 discloses providing shielding on the glass envelope of a radio frequency electron tube with a composite coating of high electrical resistance.

U.S. Pat. No. 2,875,435 discloses a composite electromagnetic energy absorbing dielectric wall, comprising a metallic reflecting layer, a dielectric layer, a high-loss-producing layer, preferably a conductive plastic or rubber or a semiconductor, and a high refractive index dielectric tuning layer.

U.S. Pat. No. 2,992,425 discloses a composite non-directional electromagnetic radiation-absorbing material, comprising a metallic substrate and two layers of polymer with electrically conducting, elongated particles, with the conducting particles in one layer having their long axes lying at right angles to the long axes of the conducting particles in the other layer.

U.S. Pat. No. 3,638,148 discloses the addition to the lid of a container for a microstrip integrated circuit of an RF-absorbing, non-reflective material such as a three-layer, ⅜ inch (0.95 cm.) thick, polyurethane foam containing a resistive compound such a carbon particles, to provide approximately the effect of free space above the circuit within the container.

U.S. Pat. No. 4,218,578 discloses a radio frequency shielding for electronic circuits including a pair of spaced conductive enclosure portions carried by an encompassing dielectric body isolating electrically each conductive enclosure so that each enclosure portion may be grounded to a different dc ground without shorting out the different dc grounds.

U.S. Pat. No. 4,567,317 discloses an enclosure or housing for electrical or electronic circuitry comprising two interfitting box-like portions of dielectric material whose inwardly facing surfaces and interfitting surface portions are provided with a thin, metallized, electrically conductive coating. The circuit to be enclosed is placed within one of the box-like portions, and the other box-like portion is interfitted with the first box-like portion to enclose the circuit by continuous conductive interior walls whose outer surfaces are dielectric.

Notwithstanding the years of inventive and development effort, electrical circuits and microwave circuitry, as a practical matter, must often be contained in packages that are metallic or have conductive surfaces of low electrical resistivity.

Electrical and electronic engineers have long recognized that at ultra-high frequencies, the high-frequency energy within, for example, a container for a radio transmitter may be reflected within the transmitter and can create standing waves and a resonant cavity condition that can induce currents in the operating circuits that may be out of phase with desired operating currents and can modify intended circuit operation. U.S. Pat. No. 2,293,839, for example, discloses the addition of an energy absorbent material, such as fibers of conductive material like steel wool, to the reflecting surfaces of a grounded metal circuit container.

Packaging to shield or protect microwave circuitry presents a danger of substantial problems in the operation of the circuits, particularly where the circuits are large and operate at significant power levels. The packages themselves may act as resonant cavities and support resonant modes with high Q's that interfere with the desired operation of the packaged circuits.

Many circuits, especially monolithic microwave integrated circuits (MMIC's), must be placed in metal packages which are large enough to support resonant modes at their frequencies of operation. The frequencies of the resonant modes of a metal package decrease as the package dimensions increase, increasing the likelihood of interference with the enclosed circuit. If these resonant modes have a very high quality factor Q, as is usually the case, even a very loose coupling between the circuit and these modes can disturb circuit operation.

This problem has been addressed in at least one instance by decreasing certain package dimensions. U.S. Pat. No. 4,713,634 discloses a metallic container for a microwave circuit, including an interior cavity formed by metallic walls designed to increase the cutoff frequency of the waveguide propogation mode within the cavity above the operating frequency of the circuit. The metallic walls that form the interior cavity include sidewall portions, such as sidewall projections, that reduce the dimension of the cavity cross section that is parallel to the sidewalls with the circuit input and output, thereby decreasing the cutoff frequency wavelength and increasing the cutoff frequency of waveguide propogation mode above the operating frequency of the microwave circuit.

The undesirable interaction between the circuit and the resonant cavity modes of the package can also be reduced by dampening the resonant cavity modes. Conventional microwave absorbers composed of materials with bulk resistive properties may be placed in the package for this purpose, as, for example, in U.S. Pat. No. 3,638,148. Circuit reliability may be compromised, however, if microwave absorbers based on organic materials such as silicon rubber with a potential for outgassing are placed in the package with GaAs MMIC's. Furthermore, many microwave absorbers based on inorganic materials are difficult to machine to the small thicknesses required at microwave frequencies.

The inventor, in "Damping of the Resonant Modes of a Rectangular Metal Package", *IEEE Trans. Microwave Theory and Techniques,* Vol. MTT 37, No. 1, January 1989, has disclosed that the resonant modes of a rectangular metal package may be damped by fixing a dielectric substrate coated with a thin resistive film to one of its walls solve the reliability and machining problems associated with many conventional microwave absorbers. This is similar to the approach used in the Jaumann absorber disclosed in "Tables for the design of The Jaumann Microwave Absorber", *Microwaves,* Vol. 30, No. 9, pp. 219-222, September 1987, J. R. Nortier, C. A. Vander Neut, and D. E. Baker, in which resistive films supported by low dielectric substrates are placed at roughly quarter-wavelength intervals from a ground plane to suppress electromagnetic reflections; however, my technique differed, however, in that the substrates may have a high dielectric constant, may be much thinner, and are designed to suppress resonant modes rather than propagating waves.

DISCLOSURE OF INVENTION

The invention of this application provides a much improved method and apparatus for damping unwanted resonant modes in microwave assemblies and packages. The invention eliminates the use of energy absorbers and organic materials to damp resonant electrical energy and the manufacturing and reliability problems associated with prior methods and apparatus. In contrast, my invention permits simple fabrication of microwave assemblies and MMIC's and the use of existing circuit structures and MIL STD enclosures.

The invention provides damping of resonant modes in a conductive enclosure for microwave circuitry carried on a conductive ground plane by interrupting the ground plane at one or more locations about the microwave circuitry and providing electrical resistance by either a resistive film or resistor spanning the one or more interruptions in the ground plane to thereby damp one or more dominant resonant modes in the enclosure. One or more interruptions (or openings) for electrical resistance may be preferably located at locations of maximum current flow of the one or more dominant resonant modes excited by the operation of the microwave circuit, or may comprise a single space or gap provided in the ground plane surrounding the microwave circuitry with a plurality of resistors located about the circuitry to dampen the dominant resonant modes. The electrical resistance for damping can be calculated with the computer program of Appendix 1.

A microwave assembly of the invention includes a substrate of dielectric material having a conductive ground plane that carries the microwave circuitry and a conductive enclosure for the microwave circuitry, and the ground plane is interrupted with one or more openings, or spaces, that are provided with electrical resistance, either in the form of an electrically resistive film or one or more electrical resistors that span the openings or spaces. The one or more openings or spaces are located generally symmetrically about the microwave circuitry and, in one practical embodiment of the invention, comprise a single space, or gap, formed in the ground plane to surround the microwave circuitry with a plurality of resistors having locations and resistance values to damp the predominant resonant modes excited in operation of the microwave circuitry.

Other features and advantages of the invention will be apparent from the drawings and detailed description that follows.

BEST MODE FOR CARRYING OUT THE INVENTION

Figure 1A:
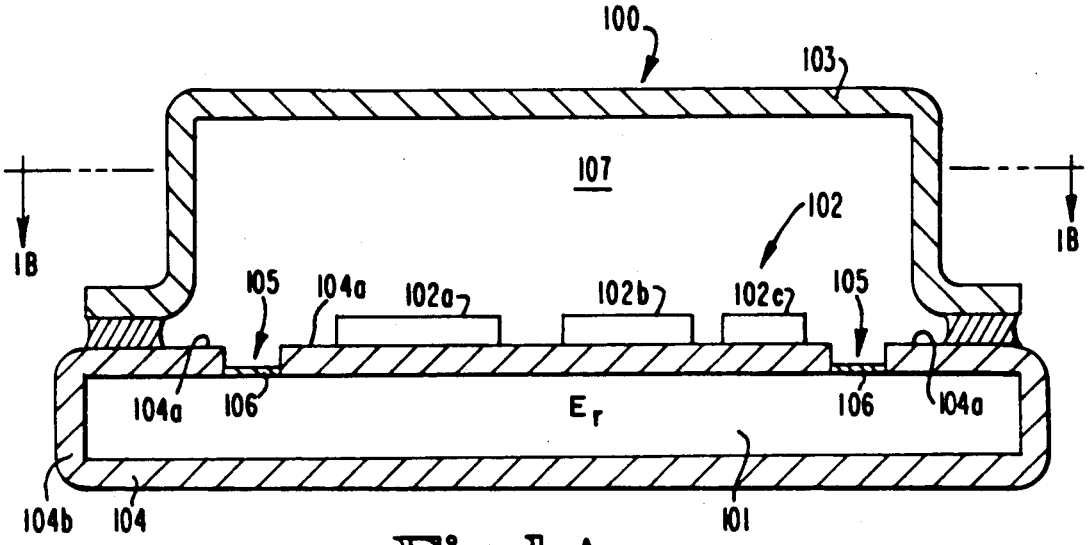
FIG. 1A is a cross-sectional view of one microwave assembly of the invention taken along a plane that traverses the center of the microwave assembly.
Figure 1B:
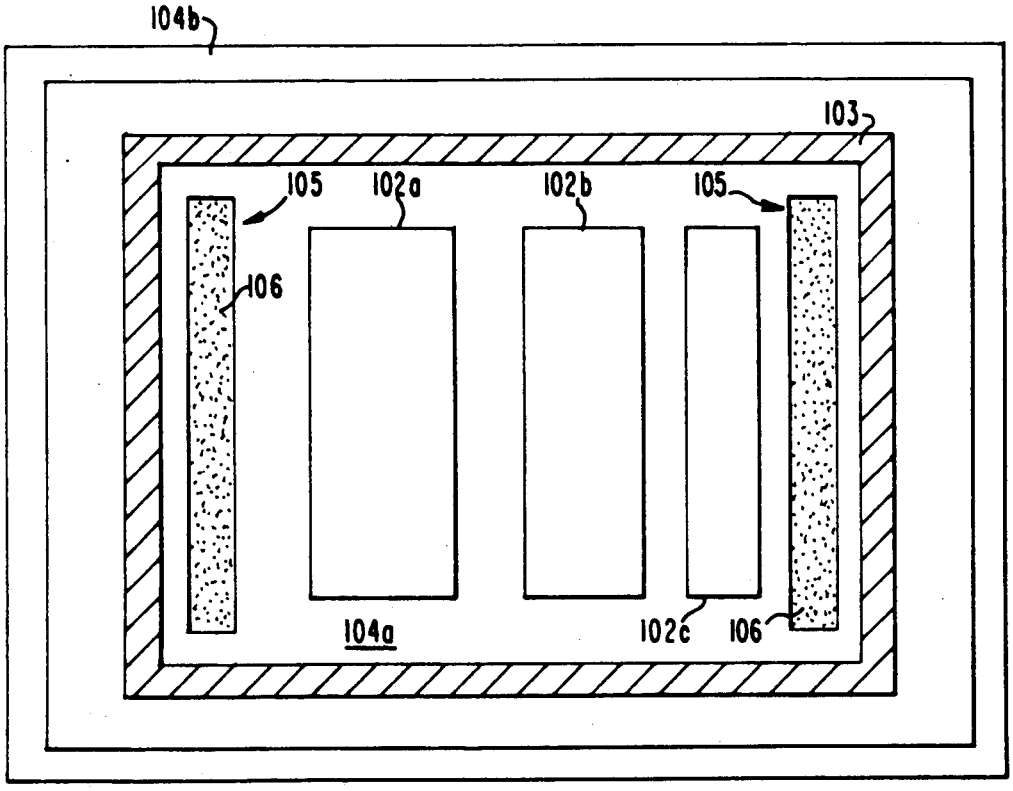
FIG. 1B is a plan view of the microwave assembly of FIG. 1A, taken at the plane of line 1B—1B FIG. 1A.

FIGS. 1A and 1B are a cross-sectional and a plan view of one embodiment 100 of a microwave assembly of the invention. Microwave assembly 100 includes a dielectric substrate 101 which supports microwave circuitry 102 comprising one or more microwave circuit elements **102*a*, 102*b*, and 102*c*. The microwave circuit elements may be, for example, gallium arsenide chip-carrying integrated microwave circuitry to provide an active microwave circuit. Microwave assembly 100 includes a metal lid 103. As shown in FIG. 1A, dielectric substrate 101 is provided with a metallized coating 104 that generally encompasses substrate 101. The metallized coating 104 of FIG. 1A includes an upper portion 104*a* that carries microwave circuitry 102 and provides a ground plane for the microwave circuitry. Although FIG. 1A shows metallized coating 104 with a lower portion 104*b*, the lower portion 104*b* is unnecessary to my invention. In my invention, the ground plane provided by metallized portion 104*a* is interrupted at one or more locations, as shown by one or more non-conductive openings or spaces 105, that are provided with one or more electrical resistances 106. Where we use the term "non-conductive opening" in this application, we mean that the opening has no material which conducts a flow of electric current. Electrical resistances 106 shown in FIGS. 1A and 1B by cross hatching and stippling respectively are resistive films that span openings or spaces 105. The resistive films 106 can be made of any resistive material. As set forth more fully below, the one or more openings 105 and the one or more electrical resistances provided at said one or more spacings are located and chosen to damp one or more predominant resonant modes that may be excited within a cavity 107, (see FIG. 1A) formed by metal lid 103 and ground plane 104. Although FIG. 1A shows metal lid 103 soldered to ground plane 104 to provide a mechanical and electrical connection, a mechanical and electrical connection between metal lid 103 and ground plane 104** is unnecessary to my invention.

It is also unnecessary in my invention that the enclosure be formed by a metal lid. In practical microwave assembles and packages, undesirable resonant modes may be formed where the electrical resistivity of the ground plane and the enclosure-forming element, such as lid 103, is less than about 0.1 ohm per square, and where I refer to a conductive ground plane or conductive enclosure herein, I mean ground plane and enclosures that are formed by materials with resistivities so low as to not significantly impede the flow of electric current.

Figure 2:
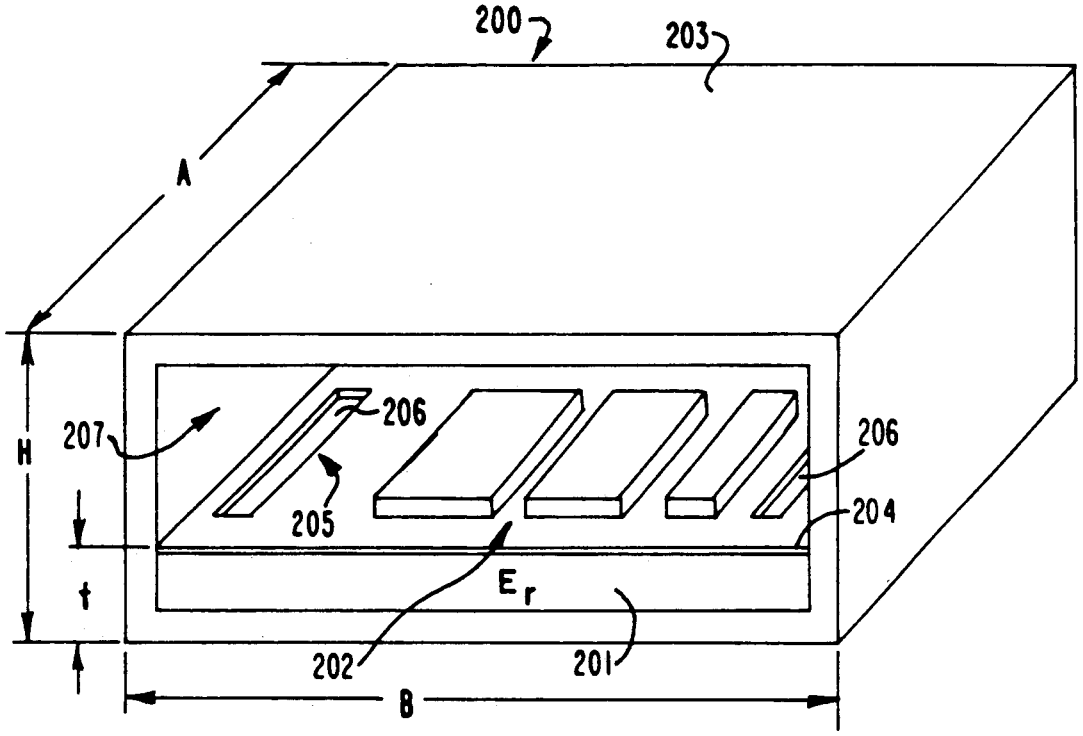
FIG. 2 is a diagram, in perspective, of a model of a microwave assembly of the invention for use with the program of Appendix 1.
Figure 4:
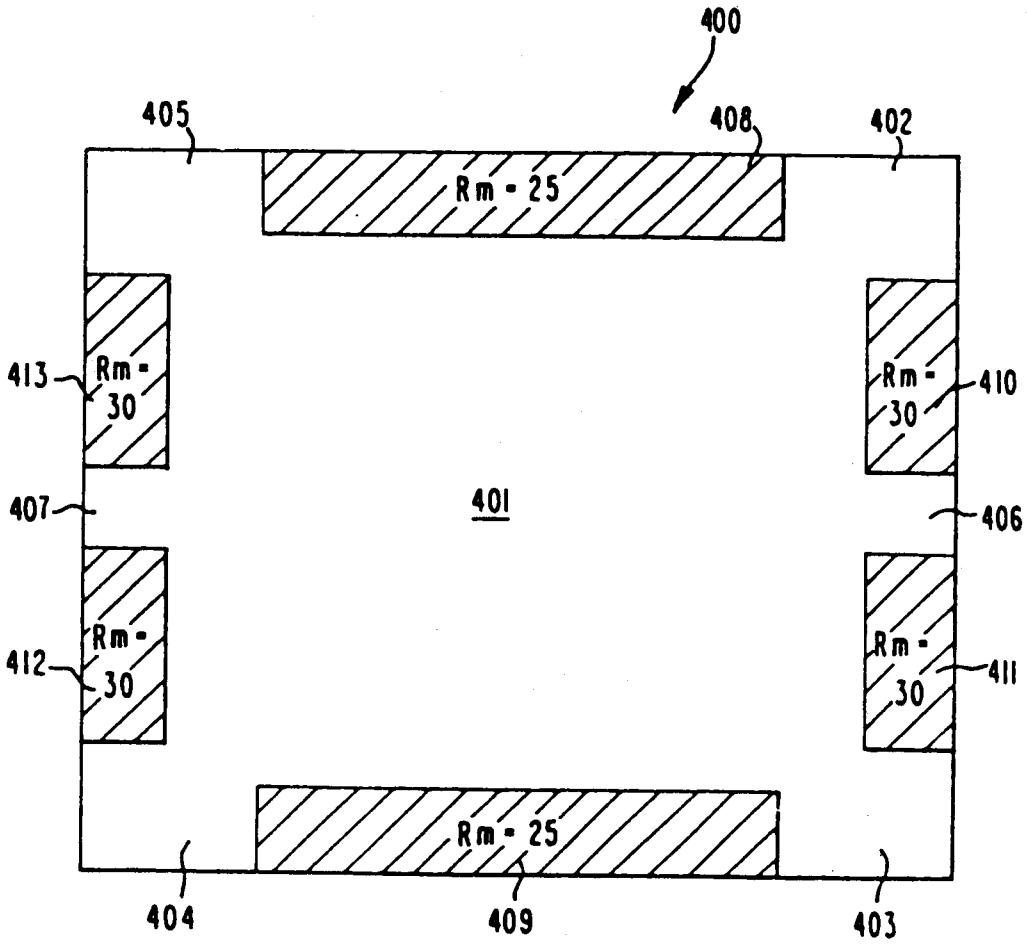
FIG. 4 is simplified plan view of a ground plane of a microwave assembly of the invention resulting from the use of the program of Appendix 1.
Figure 5A:
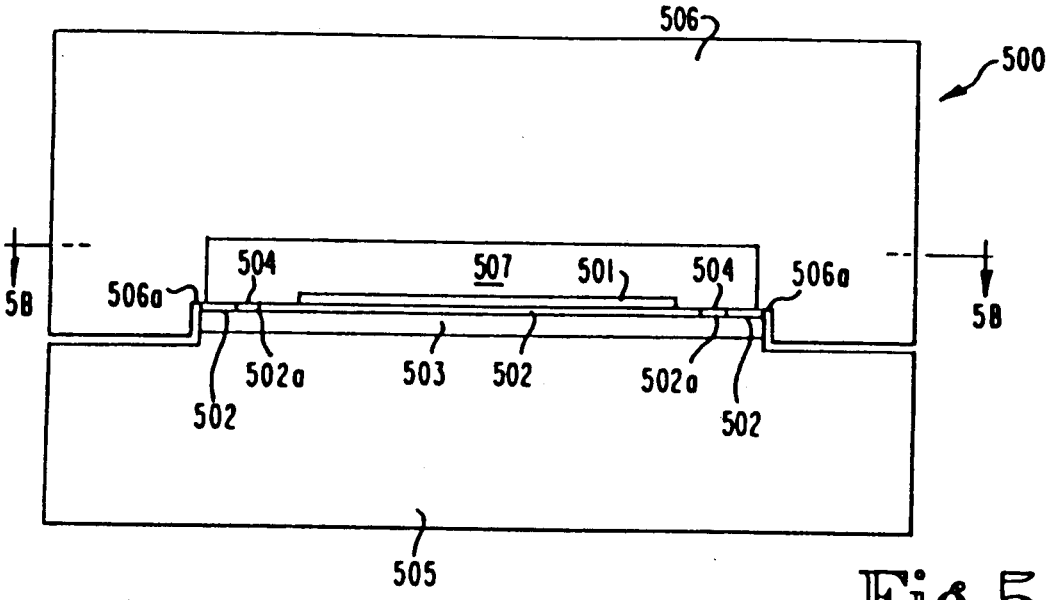
FIG. 5A is a cross-sectional view of an experimental model of one microwave assembly of the invention taken along a plane that traverses the center of the microwave assembly.
Figure 5B:
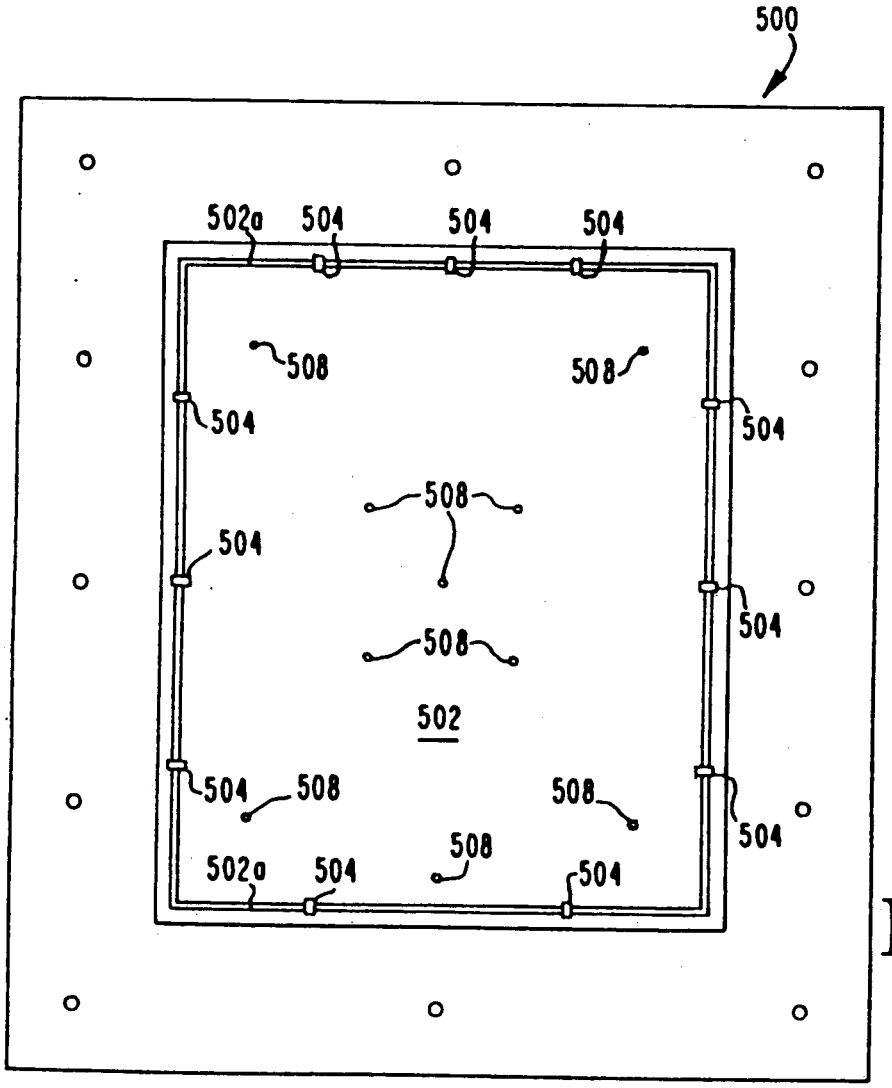
FIG. 5B is a plan view of the interior of the microwave assembly of FIG. 5A taken at a plane along lines 5B—5B of FIG. 5A; the microwave circuitry of the microwave assembly has been omitted from FIG. 5B to simplify the drawing.

FIGS. 1A and 1B illustrate the symmetrical location of the ground plane interruptions or openings or spaces 105 on opposite sides of microwave circuitry 102. It should be understood, however, that the one or more interruptions provided in the ground plane in my invention may comprise a single space, or gap, surrounding the microwave circuitry, as shown in FIGS. 5A and 5B discussed below, or a pair of openings located on opposite sides of the microwave circuitry as shown in FIG. 2, or a plurality of openings located about the microwave circuitry as shown in FIG. 4.

In preferred embodiments of my invention, one or more openings are formed at the locations of maximum current flow in the ground plane for one or more predominant resonant modes that may be excited in operation of the microwave circuitry, and the electrical resistance is selected to provide optimal dampening of these resonant modes. While those skilled in the art can determine such locations and electrical resistances, such a determination requires an iterative computation and can be accomplished more quickly and easily with a digital computer and the CAVITY program of Appendix 1.

As set forth above, FIGS. 1A and 1B illustrate a microwave assembly of this invention. FIG. 2 is a perspective model of a microwave assembly of FIGS. 1A and 1B to illustrate and identify the variables of the CAVITY program of Appendix 1. In microwave assembly 200 of FIG. 2, resonant modes of microwave energy within cavity 207 are damped by interrupting the ground plane 204 as shown by openings 205 and inserting electrical resistance 206 which can be either resistive film or lumped hybred resistors.

The resistance necessary to effectively damp a given resonant mode must be calculated. Resistances of zero and infinity are not effective to damp resonant modes within a conductive cavity encompassing a microwave circuit. The value of an effective resistance may be calculated, however, from a generalization of the solution algorithm described by me in "Damping of the Resonant Modes of a Rectangular Metal Package", *IEEE Trans. Microwave Theory and Technique*, Vol. MTT 37, No. 1, January 1989.

The computer program "CAVITY", written in FORTRAN, which is Appendix 1, available from the U.S. Patent and Trademark Office, can be used to both identify the resonant modes which may interfere with circuit operation and predict the effect of placing resistance in the ground plane. The program cannot predict the effects of RF feed throughs or DC bias and control connections on the substrate; and in some circumstances, experiments may be needed to confirm or adjust the resistance values determined by the program. The computer program CAVITY, Appendix 1, can analyze the microwave assembly geometry shown in FIG. 2; and FIG. 2 shows the program variables as follows: A is the width of cavity 207; B is the length of cavity 207; t is the thickness of the dielectric substrate having physical properties including a dielectric Er constant; and H is the height of cavity 207 plus the substrate thickness t.

Although the use of the CAVITY program will be apparent to those skilled in the art, the following explanation should be helpful. Consider, for example, a microwave cavity of FIG. 2 having the following dimensions:

A=4.8 cm.
B=4.0 cm.
H=0.22 cm.
T=0.05 cm.
Er=10

First the transverse magnetic (TM) modes of interest should be identified. For this purpose, it is necessary only to consider one mode in the solution procedure at a time. The cavity modes of interest will be the $TM_{nmo}$ modes if the length and width of the cavity is large compared to its height. A table, such as that shown in Table 1 below, should be compiled. Such a table allows the modes of interest to be easily identified. In this case, the $TM_{12o}$ mode was selected for study.

TABLE 1

The lowest order resonant modes and their frequencies for a microwave package with a carrier of dielectric constant $E_r$ = 10 and cavity dimensions A = .048 meters (1.9 inches), B = .040 meters (1.6 inches), H = .0022 meters (90 mils), and t = .0005 meters (20 mils).

| Mode | Resonant Frequency |
|---|---|
| $TM_{11o}$ | 4.88 GHz |
| $TM_{21o}$ | 7.1 GHz |
| $TM_{12o}$ | 8.12 GHz |
| $TM_{22o}$ | 9.75 GHz |
| $TM_{31o}$ | 10.1 GHz |
| $TM_{13o}$ | 12 GHz |

Figure 3:
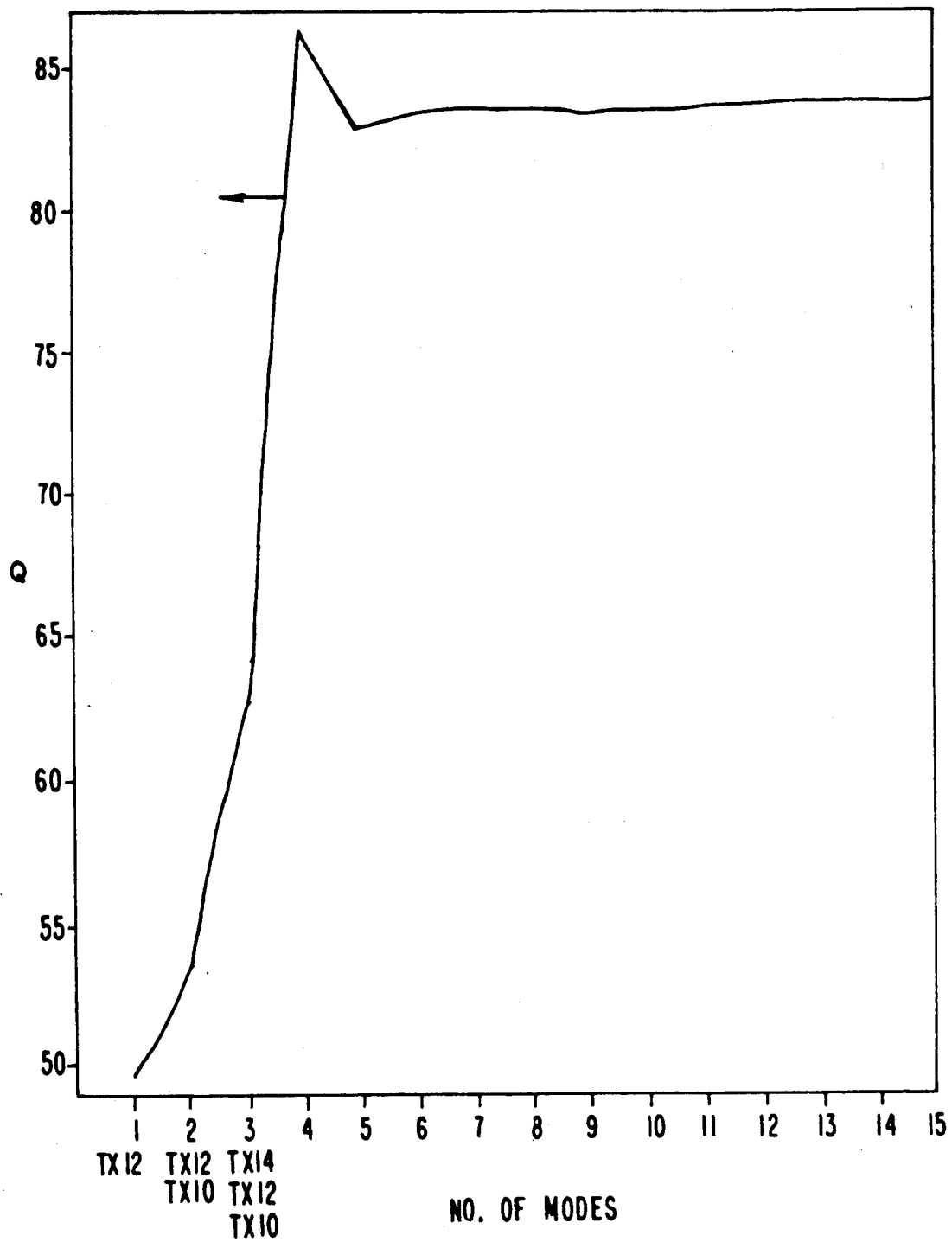
FIG. 3, is a graph showing a calculated quality factor Q for one dominant mode as a function of the number of modes used with the program of Appendix 1.

The next step is to identify the number of TM modes which must be included in the solution procedure to obtain accurate results. Plotting the quality factor as a function the number of TM modes used in the solution algorithm, as has been done in FIG. 3, is recommended for this purpose. FIG. 3 shows the Q of the damped cavity on the vertical axis for the number of modes identified on the horizontal axis. Note that in the case considered in FIG. 3, only the $TM_{1(2k)}$ modes are coupled to the $TM_{12o}$ mode due to the absence of variation in the y direction and the even symmetry in the x direction.

Once the number of modes required in any one dimension for an accurate solution has been determined, the full mode suppression problem may be addressed.

The CAVITY program, Appendix 1, may be run by the following procedure:

1. Type "EDIT CAVITY.FOR" and set up the cavity dimensions in the program. The resonant modes in the package are similar to the standard TM and TE resonant modes in a rectangular cavity, except that the resistive and metal films at the air-dielectric interface couple all of the evanescent TM and TE modes in the substrate and cavity region together. Thus, it is necessary to specify a finite number of these evanescent modes which will be used by the program to match the boundary conditions at the air-dielectric interface. Accurate results cannot be obtained unless enough of these evfanescent modes are specified. Run times can be shortened substantially by eliminating evanescent modes which are not excited due to symmetry.

2. Type "FORT CAVITY" to compile the program.

3. Type "LINK CAVITY,IMSL/LIB" to link the fortran program to the IMSL library.

4. Type "RUN CAVITY" to run the program.

The program will prompt the user with several questions relating to program operation. Use a "1" for a yes answer and a "0" for a no answer. When the program asks for the substrate to be selected, a yes answer will analyze the configuration in FIGS. 1A and 2. A no answer will ignore the effect of the substrate and the wraparound ground. When the program asks for a "TM" or "TE" mode, a yes answer chooses a guess for a frequency which should converge to the $TM_{nmo}$ mode. A no answer chooses a guess that should converge to either a $TM_{nml}$ or a $TE_{nml}$ mode. (There are no $TE_{nmo}$ modes.) If an amplitude print is requested, the amplitudes of each evanescent mode used in the solution will be printed. This is useful in identifying the resonant mode and in determining which evanescent modes may not be required in the solution procedure due to symmetry.

Next, the program will ask for a target mode number and the maximum number of modes to be used in the solution process. The target mode number will be used to generate a guess for the mode frequency. In most circumstances, the program will converge to the targeted mode. The mode amplitudes should be printed if there is any question about upon which mode has been converged.

At this point, the program will enter a loop. The resistance of a patch may be varied at this point via the absolute value of the variable RESIST. This allows the resistance of a patch to be varied until the point of optimal damping is reached.

The solutions are found by searching for a frequency in the complex plane for which the boundary conditions at the air-dielectric interface are approximately satisfied. The solution algorithm is based on the fact that the determinant of a matrix generated by the routine vanishes when these boundary conditions are satisfied. At each guess, the Jacobian of the determinant is calculated using finite differences. The Jacobian is used to estimate the location of the zero of the determinant. This estimate forms the basis for the next guess. This iterative algorithm can be thought of as the extension of Newton's algorithm to the complex plane.

The variable RESIST is also used to modify this solution algorithm. If RESIST is set to a number greater than zero, the solution is found by starting at the frequency of the last solution and searching for the next solution. If RESIST is set to a number less than zero, the solution is converged upon in two phases. In the first phase, only modes with mode numbers less than or equal to the target mode number are used to generate a guess for the complex resonant frequency of the mode. Convergence is speeded because the size of the matrix which must be inverted is small. In the second phase, all of the modes are used. Convergence may be quicker, especially if steps in resistances are large, because the starting point for the search using the full matrix is already close to the actual solution.

FIG. 4 shows a plan view of a microwave assembly 400 that has the same dimensions as the microwave assembly shown in FIG. 2. An exemplary calculation was made with the CAVITY program, Appendix 1, for such a microwave assembly. Ground plane 401 was considered to have metal at the corners 402, 403, 404, 405 and at the edge portions 406, 407 near the typical location of RF feedthroughs and bias connectors to better estimate optimal resistance in the presence of such feedthroughs and connections. Ground plane openings 408, 409 in the longer dimensions "A" were 0.6 A. long and 0.1 B wide. There were two ground plane openings 410–413 in each of the shorter dimensions B, and each such opening 410–413 was 0.25 B long and 0.1 A wide. The resistance in openings 408, 409 was calculated to be a resistive film with a resistance of 25 ohms per square. The resistance in openings 410–413 was calculated to be 30 ohms per square. The modes used in the solution procedure were: $TM_{50}$, $TM_{52}$, $TM_{54}$, $TM_{12}$, $TM_{10}$, $TM_{14}$, $TM_{16}$, $TM_{30}$, $TM_{32}$, $TM_{34}$, $TM_{36}$, $TM_{56}$, $TM_{70}$, $TM_{72}$, $TM_{74}$, $TE_{50}$, $TE_{52}$, $TE_{54}$, $TE_{12}$, $TE_{10}$, $TE_{14}$, $TE_{16}$, $TE_{30}$, $TE_{32}$, $TE_{34}$, $TE_{36}$, $TE_{56}$, $TE_{70}$, $TE_{72}$, $TE_{74}$. The calculation shows that the $TM_{12o}$ mode would be quite well suppressed by the resistances of openings 408–413. Specifically, the calculation solution, with the above assumptions, provides a quality factor of 30.93 for the $TM_{12o}$ mode at a frequency of 7.9852 GHz in such a microwave assembly.

Experiments further confirm that this invention provides substantial suppression of resonant modes in microwave packages and assemblies.

FIGS. 5A and 5B illustrate a package model 500 used in these experiments. FIG. 5A is a cross section of the microwave assembly taken at a plane through it center, and FIG. 5B is a plan view of the microwave assembly at plane 5B—5B of FIG. 5A. Microwave circuitry 501 is omitted from FIG. 5B for clarity. In this packaging scheme, microwave circuitry 501 is soldered to ground plane 502 on the top surface of dielectric substrate 503, which is often referred to as the "carrier". Carrier 503 was made of DUROID and provided mechanical support for the microwave circuitry. Microwave circuitry 501 is enclosed by a metal base 505 and a metal lid 506 which form a cavity 507.

The resonant modes were suppressed by interrupting the ground plane of the circuit carrier with a 20-mil gap **502*a* (FIG. 5B) around its periphery. The gap was bridged with hybrid ten-ohm resistors 504. The placement of these resistors is also shown in FIG. 5B. The resistor values were chosen on the numerical results obtained with the CAVITY program, Appendix 1, as described above. The $TM_{12}$ mode was predicted to have a quality factor of 68.7 and a resonant frequency of 7.99 GHz with this choice of resistors. A ground contact to metallized ground plane 502 of carrier 503 was made by the stepped edge 506a in lid 506. This edge overlapped carrier 503 and ground plane 502 by 20 mils. The height of cavity 507** above the carrier ground plane was 0.165 cm. (65 mils).

Carrier 502 normally contains a plurality of RF feedthroughs, DC bias, and control lines. The effect of the RF feedthroughs were simulated by placing screws 508 through the 0.06 cm (25 mil) thick DUROID carrier substrate. Duroid substrate 503 has a dielectric constant of 10.5.

Two coupling loops were inserted into cavity 507. The unloaded quality factor of the resonant modes of the mockup were then measured by measuring the transmission through the cavity. The unloaded quality factor of all modes between 7 GHz and 9 GHz were measured both with and without the five center screws. The results of the measurements are given in Table 2 below and show a good correlation between calculated and experimental results.

TABLE 2

The unloaded quality factors ($Q_u$) of the modes of the package model of FIGS. 5A and 5B are listed.

| Frequency (GHz) | $Q_u$ | Presence of Simulated Feedthroughs |
|---|---|---|
| 7.765 | 84 | Five Center Screws Present |
| 7.96 | 63 | Five Center Screws Present |
| 7.87 | 70 | Five Center Screws Removed |
| 7.715 | 56 | Five Center Screws Removed |
| 8.425 | 179 | Five Center Screws Removed |
| 8.6 | 81 | Five Center Screws Removed |

The invention thus provides a method and apparatus for damping resonant modes that may be generated in microwave assemblies and packages during operation of the microwave circuitry. The invention provides a simple and inexpensive package and can prevent adverse interference with circuitry operation.

Prior packaging of semiconductor devices and integrated circuitry has included other structures that have been directed generally to different problems than my invention and is generally unrelated to my inventions, as shown, for example, by the following patents.

U.S. Pat. No. 3,735,209 discloses a package for semiconductor devices having an encompassing, resilient, energy-absorbing layer to prevent sound energy or vibrations from interfering with the structure of the semiconductor device.

U.S. Pat. No. 3,740,672 discloses a carrier for semiconductor devices that is especially adapted to permit cascading class A amplifiers by providing an interconnecting microstrip transmission section on the carrier comprised of a core of a good dielectric, such as alumina, provided with top and bottom layers of a suitable conductive material such as chronium-copper. The impedance of the interconnecting microstrip transmission section can be designed to provide the required load impedance for one amplifier and the required source impedance for the second amplifier.

U.S. Pat. No. 3,904,886 discloses a technique for damping unwanted power system oscillations in integrated circuitry by providing a non-magnetic, conductive, layer forming a closed loop closely adjacent, but insulated from, the power conductors of the integrated circuitry or by providing a highly doped semiconductor substrate closely adjacent or under the power conductors.

U.S. Pat. No. 4,326,095 discloses a two-part casing for a semiconductor memory chip that is adapted to provide a line-of-sight barrier to prevent alpha particles from a glass seal between the two parts from reaching the semiconductor memory chip.

While I have described a preferred method and apparatus of my invention, it should be understood that other method and apparatus may be devised with my invention without departing from the scope of the following claims.

We claim:

1. A method of providing damping of resonant modes in a conductive enclosure for microwave circuitry carried on a conductive ground plane, comprising:

interrupting the electrical continuity of the ground plane in at least one location located between the microwave circuitry and the conductive enclosure; and providing electrical resistance spanning the at least one interruption in the ground plane.

2. The method of claim 1 comprising the further steps of positioning the at least one location to interrupt a maximum current flow for at least one resonant mode of operation of the microwave circuitry and providing said electrical resistance at the position of maximum current flow.

3. The method of claim 1 wherein the resistance is provided by disposing a resistive film at said interruption.

4. The method of claim 1 wherein the resistance is provided by disposing at least one resistor spanning said at least one interruption.

5. The method of claim 1 wherein said ground plane is interrupted by a single small gap surrounding said microwave circuitry.

6. The method of claim 1 wherein said ground plane is interrupted by a plurality of non-conductive openings spaced about said microwave circuitry.

7. A microwave assembly, comprising:

a substrate of dielectric material;

a conductive ground plane carried by said substrate;

microwave circuitry carried by said ground plane; and a conductive enclosure for said microwave circuitry with a connection between said conductive enclosure and said conductive ground plane, a single non-conductive space formed in the ground plane to surround the microwave circuitry between said microwave circuitry and said conductor enclosure, said non-conductive space being provided with a plurality of resistors spanning said non-conductive space at locations spaced about the microwave circuitry.

8. A method of providing damping of resonant modes in a conductive enclosure for microwave circuitry carried on a conductive ground plane, comprising:

interrupting the electrical continuity of the ground plane by providing a single small gap therein surrounding the microwave circuitry; and providing electrical resistance in the ground plane by disposing a plurality of resistors spanning the small gap at a plurality of locations surrounding said microwave circuitry.

9. A method of providing damping of resonant modes in a conductive enclosure for at least one microwave element carried on a conductive ground plane within the conductive enclosure, determining the locations of maximal current flow in said ground plane for at least one resonant mode excited by operation of the at least one microwave element;

interrupting the electrical continuity of the ground plane at at least one of said locations of maximal current flow of said at least one resonant mode in said ground plane; and providing resistance for maximal damping at said at least one location of said interruption.

10. A microwave assembly, comprising:

a substrate of dielectric material;

a conductive ground plane carried by said substrate;

microwave circuitry carried by said ground plane; and a conductive enclosure for said microwave circuitry with a connection between said conductive enclosure and said conductive ground plane, at least one interruptive space positioned in said ground plane between said microwave circuitry and said conductive enclosure, said interruptive space being provided with electrical resistance adapted to dampen at least one resonant mode.

11. The microwave assembly of claim 10 wherein said at least one space is provided in said ground plane and said electrical resistance comprises an electrically resistive film in said space.

12. The microwave assembly of claim 10 wherein said at least one space is provided in said ground plane and said electrical resistance comprises at least one resistor spanning said space.

13. The microwave assembly of claim 10 wherein said at least one space comprises a plurality of spaces provided at locations of maximum current flow in said ground plane for at least one resonant mode of operation of the microwave circuitry and said electrical resistance provides maximal damping of said at least one resonant mode.

14. The microwave assembly of claim 13 wherein said plurality of spaces surround said microwave circuitry.

15. The microwave assembly of claim 10 wherein said at least one space comprises a plurality of spaces arranged in said ground plane around the microwave circuitry and provided with said electrical resistance.

16. A microwave assembly, comprising:

a substrate of dielectric material;

a conductive ground plane, having electrical continuity, carried by said substrate;

microwave circuitry carried by said ground plane; and a conductive enclosure for said microwave circuitry, said ground plane's electrical continuity being interrupted at a plurality of locations, said ground plane being provided with electrical resistance at said plurality of locations.

17. The microwave assembly of claim 16 wherein said plurality of locations provided with electrical resistance comprises non-conductive openings in the ground plane and electrical resistance spaced about said microwave circuitry.

18. A microwave assembly, comprising:

a substrate of dielectric material;

a conductive ground plane carried by said substrate;

microwave circuitry carried by said ground plane; and a conductive enclosure for said microwave circuitry with a connection between said conductive enclosure and said conductive ground plane, at least one non-conductive space positioned in said ground plane between said microwave circuitry and said conductive enclosure, said at least one non-conductive space being provided with electrical resistance comprising at least one lumped resistor spanning said at least one non-conductive space.

19. A microwave circuit package, comprising:

a carrier substrate of dielectric material;

a metallic ground plane carried by said carrier substrate;

at least one microwave circuit element carried by said ground plane; and a metallic cover for said at least one circuit element electrically and mechanically connected with said ground plane;

said conductive ground plane being provided with at least one non-conductive opening between said microwave circuit element and said metallic cover, said at least one non-conductive opening being provided with electrical resistance in said ground plane, said opening and said electrical resistance being positioned within said metallic cover to damp at least one resonant mode within the metallic cover.

20. The package of claim 19 wherein said carrier substrate has a metallized side and wherein said at least one opening comprises at least two non-conductive openings formed in said metallized side of the carrier substrate spaced about said at least one microwave circuit element, and said metallic cover is soldered to said metallized side of the carrier substrate surrounding said at least one circuit element.

21. The package of claim 19 wherein said carrier substrate is mounted on a metal base and has a metallized top surface to provide said ground plane, and said metallic cover has a peripheral portion that contacts said metallized top surface of said carrier upon assembly of said package.

22. The package of claim 19 wherein said at least one non-conductive opening comprises a single non-conductive space formed in said metallic ground plane and surrounding said at least one circuit element and said electrical resistance is a plurality of resistors spanning said space, each of said resistors being located at a different location of a plurality of locations surrounding the at least one circuit element.

23. The package of claim 19 wherein said conductive cover is rectilinear with two opposed longer edges and two opposed short edges and said at least one opening comprises two non-conductive openings, one opening one each side of said one microwave circuit element, said non-conductive openings being substantially rectangular with two long sides and two short sides, the long sides being about ten times the length of the short sides, said non-conductive openings being provided with a resistive film having a resistivity of about 20 ohms per square.

24. The package of claim 19 wherein said conductive cover is rectilinear having two opposed longer edges and two opposed shorter edges and said at least one opening comprises a plurality of non-conductive openings along the four rectilinear edges of the enclosure, said plurality of non-conductive openings comprising (a) a pair of long rectangular openings along each of the two opposed longer edges of the enclosure and provided with a resistive film therein having a resistance of about 25 ohms per square, each of said long rectangular openings having two longer sides and two shorter sides with the longer sides having a length equal to about six times a length of their shorter sides and about one-half the wavelength of an operating frequency of the at least one microwave circuit element on the carrier substrate, and (b) a pair of short rectangular openings along each of the two opposed shorter edges of the enclosure and provided with a resistive film therein having a resistance of about 30 ohms per square, each of said short rectangular openings having two longer sides and two shorter sides with the longer sides having length equal to about three times a length of their shorter sides and slightly less than one-quarter wavelength of said operating frequency of the microwave elements in the carrier substrate.

* * * * *